US006217290B1

(12) United States Patent
Imai et al.

(10) Patent No.: US 6,217,290 B1
(45) Date of Patent: Apr. 17, 2001

(54) CONTROL VALVE FOR VARIABLE CAPACITY COMPRESSORS

(75) Inventors: Masayuki Imai; Yoshiyuki Kume, both of Tokyo; Yukio Kazahaya, Saitama, all of (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 09/195,740

(22) Filed: Nov. 19, 1998

(30) Foreign Application Priority Data

Nov. 28, 1997 (JP) ..... 9-328036
Sep. 3, 1998 (JP) ..... 10-250156

(51) Int. Cl.[7] ..... F04B 1/26
(52) U.S. Cl. ..... 417/222.1; 417/270
(58) Field of Search ..... 417/222.1, 222.2, 417/270

(56) References Cited

U.S. PATENT DOCUMENTS

| | | | |
|---|---|---|---|
| 4,702,677 | 10/1987 | Takenaka et al. | 417/222 |
| 4,732,544 | 3/1988 | Kurosawa et al. | 417/222 |
| 5,145,326 | 9/1992 | Kimura et al. | 417/222.2 |
| 5,242,274 | 9/1993 | Inoue | 417/222.2 |
| 5,332,365 | 7/1994 | Taguchi | 417/222.2 |
| 5,531,572 | 7/1996 | Kimura et al. | 417/222.2 |
| 5,702,235 | 12/1997 | Hirota et al. | 417/222.2 |
| 5,797,730 | 8/1998 | Kawaguchi . | |
| 5,836,748 | 11/1998 | Kawaguchi et al. | 417/222.2 |
| 5,842,835 * | 12/1998 | Kawaguchi et al. | 417/222.2 |
| 5,865,604 * | 2/1999 | Kawaguchi et al. | 417/222.2 |

OTHER PUBLICATIONS

SAE Technical Paper Series—"A 7–Cylinder IVD Compressor for Automotive Air conditioning" by Takai et al.; SAE The Engineering Society for Advancing Mobility Land Sea Air and Space; International congress and Exposition, Detroit, Michigan, Feb. 27–Mar. 3, 1989; pp. 1–10.

* cited by examiner

*Primary Examiner*—Henry C. Yuen
*Assistant Examiner*—Mahmoud M Gimie
(74) *Attorney, Agent, or Firm*—Baker Botts L.L.P.

(57) ABSTRACT

A control valve for a variable capacity compressor; wherein an opening degree of a valve member disposed in a coolant gas passage for communicating a discharge pressure region of the variable capacity compressor with a crankcase thereof is made adjustable by a magnetization action of a solenoid, thereby causing an inclination angle of a wobble plate to change and also causing a discharging capacity of the compressor to change; and which is characterized in that the main valve body comprises a solenoid, a pressure sensitive chamber provided with bellows and a valve chamber provided with the valve member, and that the solenoid is provided with a plunger connected with one end of a stem, whose other end of the stem being detachably contacted with a stopper of the bellows, and the other end of the plunger being linked to a rod to be contacted with the valve member.

8 Claims, 7 Drawing Sheets

CONTROL VALVE FOR VARIABLE CAPACITY COMPRESSORS

BACKGROUND OF THE INVENTION

The present invention relates to a control valve for a variable capacity compressor to be employed in air conditioners for vehicles, etc., and in particular to a control valve for a variable capacity compressor, which is designed to supply, upon requirements, a coolant gas from a discharge pressure region to a crankcase.

A variable capacity compressor provided with a cylinder, a piston, a wobble plate, etc. has been conventionally employed for compressing and discharging a coolant gas of an air conditioner for vehicles, etc. One example of this conventional variable capacity compressor is constructed such that it comprises a coolant gas passage for communicating a discharge pressure region with a crankcase, so that the quantity of coolant gas to be discharged can be changed in conformity with changes in inclination angle of the wobble plate which can be effected through an adjustment of the pressure inside the crankcase. The adjustment of pressure inside the crankcase is performed by feeding a high pressure compressed coolant gas from the discharge pressure region to the crankcase while adjusting the opening degree of a control valve disposed at an intermediate portion of the coolant gas passage.

FIGS. 6 and 7 show one example of such a control valve 100' for a variable capacity compressor (hereinafter referred to simply as a control valve) (see Japanese Patent Unexamined Publication (Kokai) H/9-268,974). This control valve 100' is disposed neighboring on the rear housing 210 of the variable capacity compressor 200 and is designed to adjust the pressure inside the crankcase 231 which is disposed in a front housing 230 and next to the a cylinder block 220 of the variable capacity compressor 200.

In the interior of the crankcase 231, there are housed a wobble plate 240 which is mounted on a driving shaft 250 in such a manner that it can slide along the axial direction of the driving shaft 250 and can incline about the driving shaft 250, and also a guide pin 241 of the wobble plate 240, which is made slidable along a supporting arm 252 of a rotatable supporting body 251. The wobble plate 240 is connected via a couple of shoes 242 with a piston 260 which is slidably disposed in a cylinder bore 221.

The wobble plate 240 is designed to swing in the directions indicated by the arrows so as to change its inclination angle in conformity with a difference in pressure between a suction pressure Ps inside the cylinder bore 221 and a pressure Pc inside the crankcase 231. The stroke width of the forward and backward movement of the piston 260 in the cylinder bore 221 can be determined based on this inclination angle. Further, the inclinatory movement in the direction of arrows of the wobble plate 240 causes a cutoff body 270 contacting with a middle portion of the wobble plate 240 to move forward or backward in a housing bore 222.

The rear housing 210 is provided with suction chambers 211*a* and 211*b* each constituting an inlet pressure region, and with discharging chambers 212*a* and 212*b* each constituting a discharge pressure region. When the piston 260 is moved forward and backward as a result of the inclinatory movement of the wobble plate 240, the coolant gas in the suction chamber 211*a* is sucked into the cylinder bore 221 from a suction port 213 and then compressed to a predetermined pressure before it is discharged through a discharge port 214 into the discharging chamber 212*a*.

An inlet passage 215 formed at the central portion of the rear housing 210 is communicated with the housing bore 222 and also with the suction chamber 211*b* through a through-hole 216. When the wobble plate 240 is moved toward the cutoff body 270, the cutoff body 270 is caused to move toward the inlet passage 215 thereby causing the through-hole 216 to be closed ultimately by the cutoff body 270.

Between the inlet passage 215 and the upper end portion of the control valve 100', there is formed a pressure-checking passage 217 for introducing the suction pressure Ps into the control valve 100'. The discharging chamber 212*b* is communicated with the crankcase 231 via gas inlet passages 218 and 219 of the control valve 100'. These gas inlet passages 218 and 219 are designed to be opened or closed by means of a valve member 106' of the control valve 100'. In this case, it is designed such that a discharging pressure Pd inside the discharging chamber 212*b* is allowed to be introduced via the gas inlet passage 218 to a valve chamber port 113', while the pressure Pc inside the crankcase 231 is allowed to be introduced via the gas inlet passage 219 to a valve chamber port 114'. Further, it is also designed such that the suction pressure Ps is allowed to be introduced via the pressure-checking passage 217 into a sucking pressure-introducing port 115'.

If a temperature detected by an indoor sensor 281 is higher than a set temperature of a temperature-setting device 282 at the moment when an actuating switch 280 of air conditioner is turned on, a controlling computer 283 outputs a command to magnetize the solenoid 101' of the control valve 100'. As a result, an electric current is fed via an actuating circuit 284 to the solenoid 101' thereby causing the solenoid 101' to generate a suction force, due to which a movable core 102' is attracted, against the urging force (biasing force) of a spring 103', toward a fixed core 104'.

As the movable core 102' is moved in this manner, the valve member 106' attached to a solenoid rod 105' is caused to move, against the urging force of a forced opening spring 107', in the direction to decrease the opening degree of a valve hole 108'. As a result of this movement of the valve member 106', a pressure-sensitive rod 109' formed integral with the valve member 106' is moved upward thereby pushing up bellows 111' which is detachably connected with the pressure-sensitive rod 109' through a pressure-sensitive rod receiver 110'.

At this moment, the displacement of bellows 111' is caused in conformity with changes of the suction pressure Ps to be introduced via the pressure-sensitive passage 217 into the interior of the pressure-sensitive chamber 112', thereby giving a load to the pressure-sensitive rod 109'. Thus, the control valve 100' is designed such that the opening degree of the valve hole 108' by means of the valve member 106' is determined by a balance among the suction force of the solenoid 101', the urging force by the bellows 111' and the urging force by the forced opening spring 107'.

If the cooling load is large in this case for instance, i.e. if a difference between the temperature detected by the indoor sensor 281 and the set temperature of the room temperature-setting device 282 is large, the suction force between the movable core 102' and the fixed core 104' is increased whereby increasing the force of the valve member 106' to bias the valve hole 108' in the direction to decrease the opening degree thereof, thus making it possible to perform the opening and closing of the valve member 106' with the lower suction pressure Ps.

When the opening degree of valve by means of the valve member 106' is decreased, the quantity of coolant gas to be fed to the crankcase 231 from the discharging chamber 212*b* via the gas inlet passages 218 and 219 is decreased, thus lowering the crankcase pressure Pc in the interior of the crankcase 231.

Further, if the cooling load is large, the suction pressure Ps inside the cylinder bore 221 is increased whereby generating a difference in pressure between the suction pressure Ps inside the cylinder bore 221 and the crankcase pressure Pc inside the crankcase 231, thus enlarging the inclination angle of the wobble plate 240, whereby causing the cutoff body 270 to keep away from the inlet passage 215 to open the passage 216.

In the aforementioned conventional control valve 100', it is designed such that the discharge pressure Pd is introduced via the gas inlet passage 218 into the valve chamber port 113' of the control valve 100' as shown in FIG. 7. Since the discharge pressure Pd is high and the coolant gas generating such the high discharge pressure Pd releases an intense heat as it is compressed up to a predetermined pressure by the forward and backward movement of the piston 260, the control valve 100' itself is heated to high temperatures by the intense heat released from the coolant gas.

When the control valve 100' itself is heated to high temperatures in this manner, the temperature of the solenoid 101' is also risen so that the suction force of the movable core 102' which is originating from the solenoid 101' is weakened, thereby raising a problem that the opening or closing accuracy of the valve hole 108' by means of the valve member 106' is deteriorated. Furthermore, in the case of the conventional control valve 100', the bellows 111' is required to be incorporated into the pressure sensitive chamber 112' with the interior of the pressure sensitive chamber 112' being maintained in a closed state. Therefore, there is no space for introducing an adjusting jig into the pressure sensitive chamber 112' from outside, thereby making it impossible to perform the adjustment of loading force of the bellows 111'.

Additionally, since the application point of suction from the solenoid 101' to the solenoid rod 105' is kept away from the application point of the urging force by the bellows 111', not only there is a possibility that the solenoid rod 105' may be rattled as it is moved at the occasion of closing the valve, but also the valve member 106' may possibly be non-uniformly contacted with the valve hole 108' due to the aforementioned rattling of the solenoid rod 105' because the distal end portion of the valve member 106' for closing the valve hole 108' is simply made flat, and hence the opening or closing accuracy of the valve is hindered from being improved.

BRIEF SUMMARY OF THE INVENTION

The present invention has been made under the circumstances mentioned above, and therefore an object of the present invention is to provide a control valve for a variable capacity compressor, which is capable of improving the opening or closing accuracy of valve and also capable of easily performing the adjustment of the loading force of bellows.

The aforementioned object can be achieved by this invention by providing a control valve for a variable capacity compressor; wherein the opening degree of a valve member disposed in a coolant gas passage for communicating a discharge pressure region of the variable capacity compressor with a crankcase thereof is made adjustable by the magnetization action of a solenoid disposed in the solenoid housing which is mounted on a main valve body, thereby causing the inclination angle of the wobble plate disposed inside the crankcase to be changed and at the same time, causing the discharging capacity of the compressor to be changed; and which is characterized in that said main valve body is integrally incorporated in a rear housing of the variable capacity compressor, and that a low temperature coolant gas-introducing space communicating with a suction pressure region of the variable capacity compressor is formed between the solenoid housing and the rear housing.

In the control valve for a variable capacity compressor of this invention which is constructed as mentioned above, a low temperature coolant gas is introduced not only into a pressure sensitive chamber of the main valve body from the suction pressure region, but also into a low temperature coolant gas-introducing space formed between the solenoid housing and the rear housing, so that the entire side walls of the solenoid housing can be cooled by this low temperature coolant gas, thus making it possible to inhibit the solenoid disposed inside the housing from being deteriorated in magnetization force thereof due to heat, etc.

Further, since the main valve body is provided with a pressure sensitive chamber communicating with the suction pressure region of the variable capacity compressor, with bellows housed in the pressure sensitive chamber and functioning to move the valve member in the direction to reduce the opening degree thereof as the pressure of the suction pressure region is increased, and with an adjusting screw holder hermetically attached to the pressure sensitive chamber and provided with an adjusting screw for adjusting the strength of the bellows, it is now possible to easily perform the adjustment of strength of the bellows in the pressure sensitive chamber while maintaining the closed state of the interior of the pressure sensitive chamber.

Further, since the main valve body is integrally incorporated in the rear housing of the variable capacity compressor with the adjusting screw holder being kept directed toward outside, even if the main valve body is mounted in the rear housing, the adjustment of strength of the bellows in the pressure sensitive chamber can be easily performed from outside.

Since the main valve body is constructed such that a solenoid is disposed at the center thereof, that a pressure sensitive chamber provided with bellows is disposed at one end thereof, that a valve chamber provided with the valve member is disposed at the other end thereof, that one end of a stem is fixed at one end of the plunger of the solenoid, that a stopper of the bellows placed in the pressure sensitive chamber is detachably disposed at the other end of the stem, that a rod to be contacted with the valve member is fixed at the other end of the plunger, and that a spring for urging the plunger of the solenoid toward the valve member is disposed at one end of the plunger, the valve member can be normally kept in a state of maximum opening degree, without being influenced by the action of the bellows inside the pressure sensitive chamber, during the period when the plunger is not magnetized by the solenoid.

Additionally, since the pressure sensitive chamber is disposed close to the solenoid, the distance between the application point by the suction of the solenoid and the application point by the bellows can be shortened, whereby the rattling of an operating bar constituted by the aforementioned rod and stem can be minimized as these rod and stem are moved in the direction of closing the valve.

Further, since the valve member is spherical in shape, the valve member can be uniformly contacted with the valve hole even if the operating bar is inclined at the occasion of closing the valve.

DETAILED DESCRIPTION OF THE INVENTION

The present invention will be further explained with reference to the drawings depicting one embodiment of a control valve for a variable capacity compressor according to one embodiment of the present invention.

Figure 1:
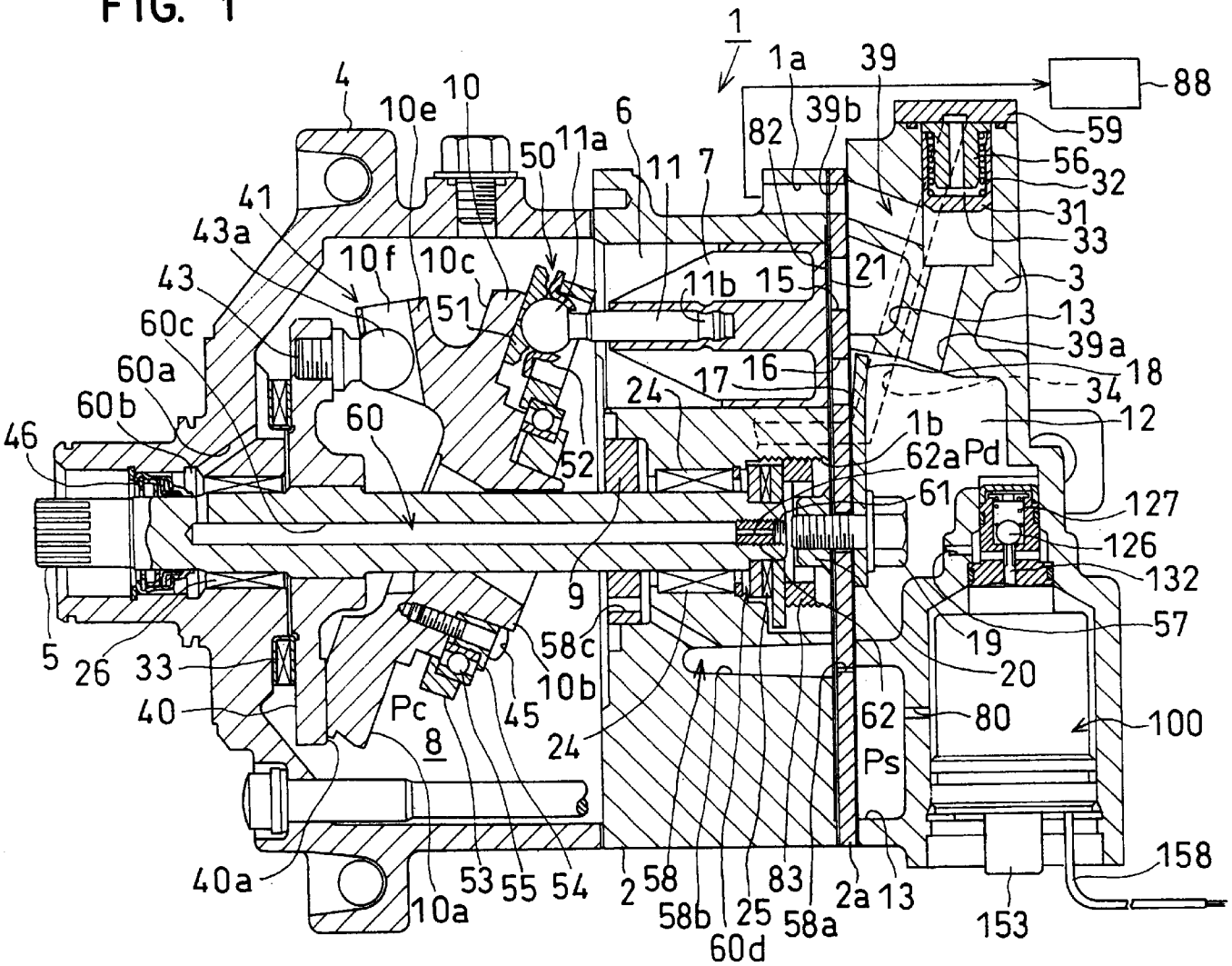
FIG. 1 is a longitudinal sectional view illustrating a variable capacity compressor provided with a control valve according to one embodiment of the present invention, wherein the discharge passage thereof is being opened.
Figure 2:
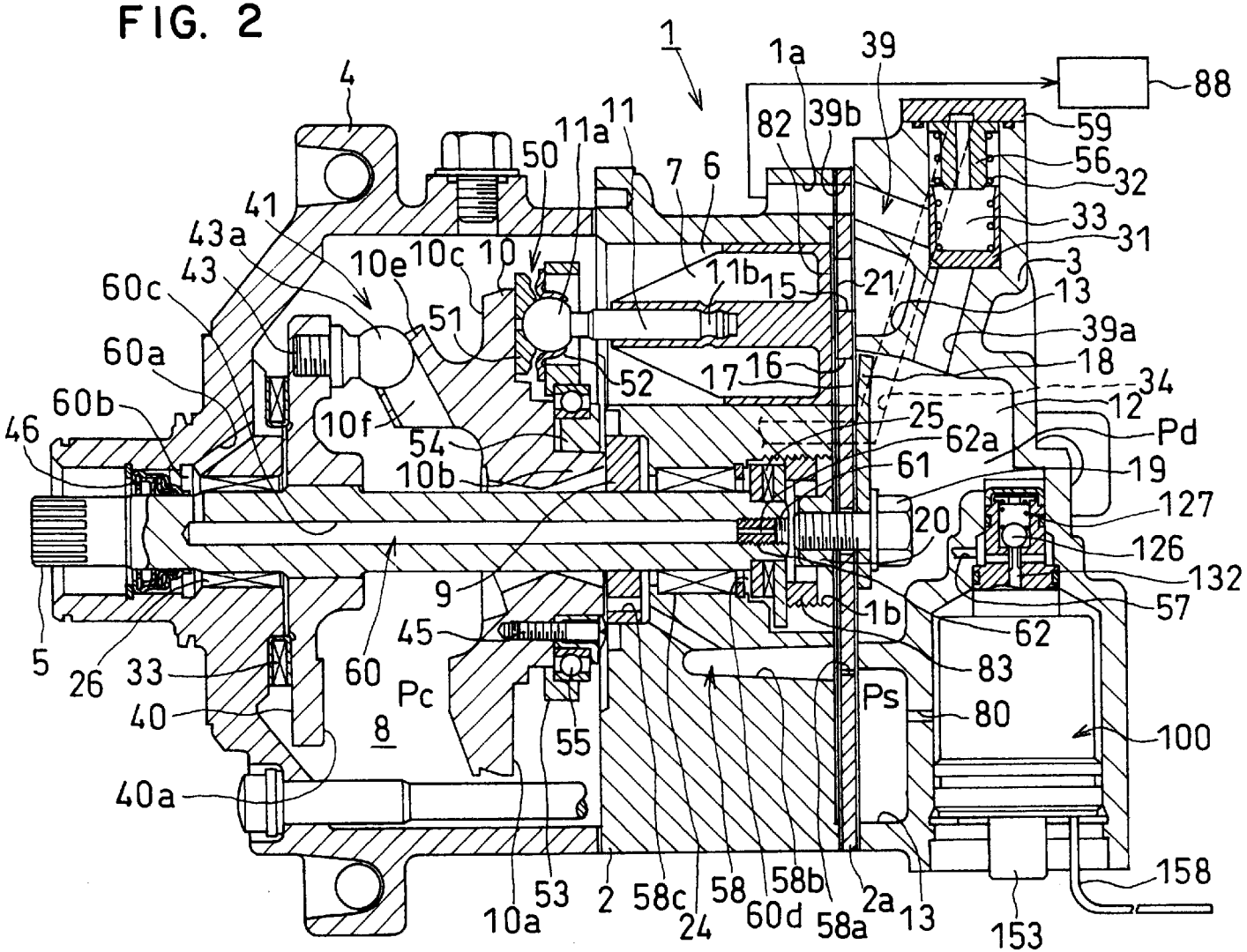
FIG. 2 is a longitudinal sectional view illustrating the variable capacity compressor of FIG. 1, wherein the discharge passage thereof is being closed.

FIGS. 1 and 2 show longitudinal sectional views of a variable capacity compressor 1 provided with a control valve 100 according to this embodiment, wherein FIG. 1 shows a state where the discharge passage of the variable capacity compressor 1 is opened, while FIG. 2 shows a state where the discharge passage is closed.

To one end face of the cylinder block 2 of the variable capacity compressor 1 is attached, via a valve plate 2*a,* a rear housing 3, while to the other end face of the cylinder block 2 is attached a front housing 4. The cylinder block 2 is provided with a plurality of cylinder bores 6 which are arranged about a shaft (rotational axis) 5 at predetermined intervals along the circumferential direction. In each of these cylinder bores 6, a piston 7 is slidably housed.

The front housing 4 is provided therein with a crankcase 8 in which a wobble plate 10 is housed. The wobble plate 10 is provided with a sliding surface 10*a* to which a shoe 50 for rotatably supporting a spherical end portion 11*a* of a connecting rod 11 is sustained by means of a retainer 53. This retainer 53 is mounted via a radial bearing 55 on the boss 10*b* of the wobble plate 10, and is made rotatable in relative to the wobble plate 10. The radial bearing 55 is prevented from being come off by means of a stopper 54 which is fixed with a screw 45 to the boss 10*b*.

The shoe 50 is constituted by a main shoe body 51 rotatably supporting a fore-end face of the spherical end portion 11*a* of the connecting rod 11, and by a washer 52 rotatably supporting a rear-end face of the spherical end portion 11*a* of the connecting rod 11.

The rear housing 3 is provided with a discharge chamber 12 and with a suction chamber 13. The suction chamber 13 is disposed to surround the discharge chamber 12. The rear housing 3 is also provided with an inlet port (not shown) which is communicated with an outlet port of an evaporator (not shown). FIG. 1 illustrates a state where the discharge passage 39 is being opened, while FIG. 2 illustrates a state where the discharge passage 39 is being closed. This discharge passage 39 which is disposed for communicating the discharge chamber 12 with a discharge port 1*a* is provided at an intermediate portion thereof with a spool valve (discharge controlling valve) 31. This discharge passage 39 is constituted by a passage 39*a* formed in the rear housing 3 and by a passage 39*b* formed in the valve plate 2*a*. The passage 39*b* is communicated with the discharge port 1*a* formed in the cylinder block 2.

The spool valve 31 which is constituted by a bottomed cylindrical body is provided therein with a spring (an urging member) 32. One end of the spring 32 is contacted with a stopper 56 which is secured to the rear housing 3 by means of a cap 59, while the other end of the spring 32 is contacted with the bottom surface of the spool valve 31. The inner space 33 of the spool valve 31 is communicated via a passage 34 with a crankcase 8.

It is designed that one side (upper side) of the spool valve 31 is subjected to an urging force from the spring 32 and to a pressure from the crankcase 8 both of which are directed to close the valve 31 (a direction to reduce the opening degree of valve). At the moment when the spool valve 31 is being opened, the discharge port 1*a* is allowed to communicate with the discharge chamber 12 through the discharge passage 39 (see FIG. 1). Therefore, the other side of the spool valve 31 is subjected to a pressure from the discharge port 1*a* and to a pressure from the discharge chamber 12 both of which are directed to open the valve 31 (a direction to enlarge the opening degree of valve). However, when a difference in pressure between the crankcase 8 and the discharge port 1*a* is decreased to less than a predetermined value, the spool valve 31 is moved in the valve-closing direction thereby to shut off the discharge passage 39, thus allowing only the pressure from the discharge chamber 12, which is directed in the valve-opening direction, to act on the lower side of the spool valve 31. Namely, the pressure from the discharge port 1*a* is no more acted on the lower side of the spool valve 31.

The discharge chamber 12 is communicated via a second passage 57 with the crankcase 8. This second passage 57 is provided at an intermediate portion thereof with a control valve (for a variable capacity compressor) 100 of this embodiment as will be explained in detail hereinafter. When a heat load is large, an electric current is transmitted to the solenoid 131A of the control valve 100 thereby to actuate the valve member 126 to shut off the second passage 57. On the other hand, when a heat load is small, the transmission of electric current to the solenoid 131A is stopped thereby to cause the valve member 126 to keep away from the valve seat, thus opening the second passage 57. The operation of the control valve 100 is controlled by means of a computer (not shown).

The suction chamber 13 is communicated via a first passage 58 with the crankcase 8. This first passage 58 is constituted by a combination of an orifice (a second orifice) 58*a* formed in the valve plate 2*a,* a passage 58*b* formed in the cylinder block 2, and a through-hole 58*c* formed in a ring (an annular body) 9 which is fixed to the shaft 5. The suction chamber 13 is communicated with the crankcase 8 also through a third passage 60. This third passage 60 is constituted by a combination of a passage 60*a* formed in the front housing 4, a front side bearing-receiving space 60*b,* a passage 60*c* formed in the shaft 5, a rear side bearing-receiving space 60*d,* the passage 58*b* formed in the cylinder block 2, and the orifice 58*a* formed in the valve plate 2*a*. Namely, the passage 58*b* in the cylinder block 2 and the orifice 58*a* in the valve plate 2*a* constitute not only part of the first passage 58 but also part of the third passage 60.

The passage 60*c* is provided at the rear side end portion thereof with an internal thread 61 into which a screw 62 is fitted. This screw 62 is provided with an orifice (a first orifice) 62*a* having a cross-sectional area which is smaller than that of the second orifice 58*a* formed in the valve plate 2*a* and constituting part of the first passage 58. Therefore, only when the through-hole 58*c* of the ring 9 is nearly closed by the boss 10*b* of the wobble plate 10 and hence the cross-sectional area of the first passage 58 is extremely reduced, a coolant in the crankcase 8 is permitted to enter the suction chamber 13 through this third passage 60.

The valve plate 2*a* is provided with discharge ports 16 for communicating a compression chamber 82 with the discharge chamber 12, and with inlet ports 15 for communicating a compression chamber 82 with the suction chamber 13, these inlet ports 15 and discharge ports 16 being provided at predetermined intervals along the circumferential direction. The discharge ports 16 are adapted to be closed or opened by means of the discharge valve 17 which is secured together with a valve-holding member 18 to a rear housing side end face of the valve plate 2*a* by making use of a bolt 19 and a nut 20. The suction ports 15 are adapted to be closed or opened by means of the suction valve 21 which is interposed between the valve plate 2*a* and the cylinder block 2.

The rear side end portion of the shaft 5 is rotatably supported by a radial bearing (a rear side bearing) 24 and a thrust bearing (a rear side bearing) 25, both bearings being housed in the rear side bearing-receiving space 60*d* formed in the cylinder block 2. The front side end portion of the shaft 5 is rotatably supported by a radial bearing (a front side bearing) 26 which is housed in the front side bearing-receiving space 60*b* formed in the front housing 4. In addition to the radial bearing 26, a shaft seal 46 is also housed in the front side bearing-receiving space 60*b*.

The cylinder block 2 is provided at the central portion thereof with an internal thread 1*b* into which an adjust nut 83 is fitted. When this adjust nut 83 is tightened, a preload can be given to the shaft 5 through the thrust bearing 25. A pulley (not shown) is fixed to the front side end portion of the shaft 5.

A thrust flange 40 for transmitting the rotational movement of the shaft 5 to the wobble plate 10 is also fixed to the shaft 5. This thrust flange 40 is sustained on the inner wall of the front housing 4 by means of a thrust bearing 33. The thrust flange 40 is connected with the wobble plate 10 by means of a hinge structure 41, so that the wobble plate 10 can be inclined relative to an imaginary surface perpendicular to the shaft 5. Namely, the wobble plate 10 is slidably and inclinably mounted on the shaft 5.

The hinge structure 41 is constituted by a combination of a bracket 10*e* attached to the front face 10*c* of the wobble plate 10, a linear guiding groove 10*f* formed in the bracket 10*e*, and a rod 43 engaged with the wobble plate side side-wall 40*a* of the thrust flange 40. The longitudinal axis of the guide groove 10*f* is inclined to a predetermined angle in relative to the front face 10*c* of the wobble plate 10. The spherical portion 43*a* of the rod 43 is slidably fitted in this guide groove 10*f*.

Figure 3:
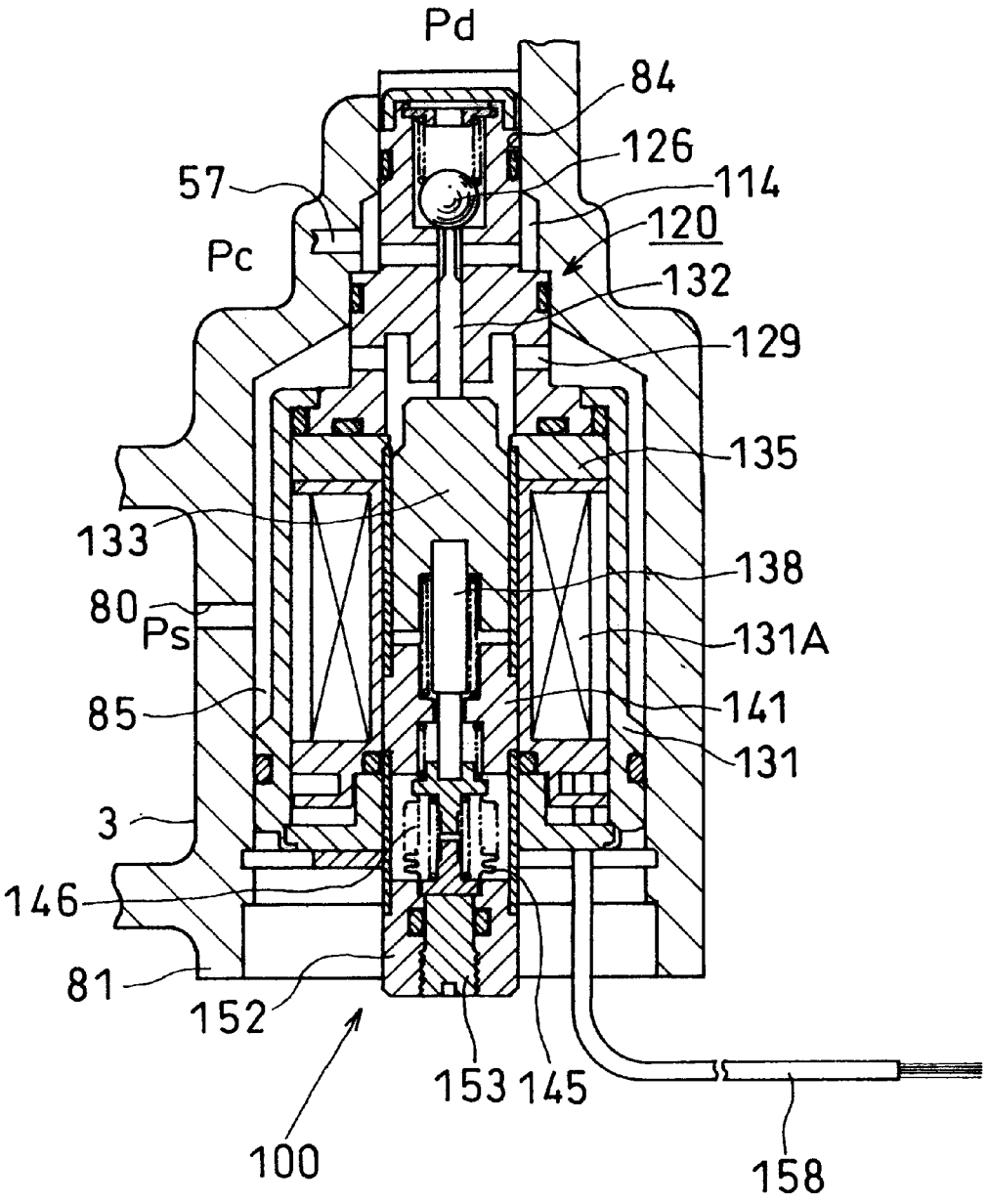
FIG. 3 is an enlarged longitudinal sectional view of the control valve of the variable capacity compressor shown in FIG. 1.
Figure 4:
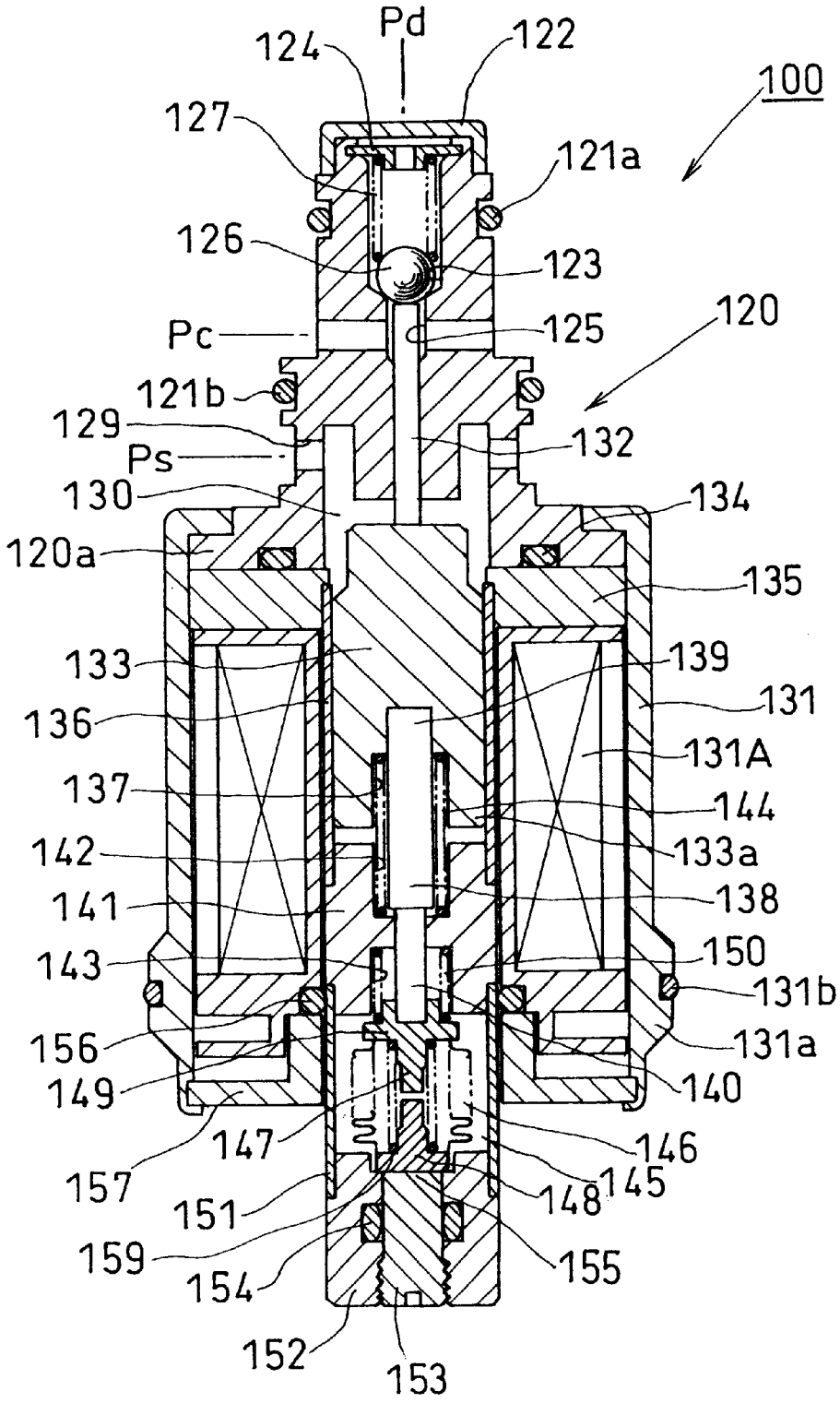
FIG. 4 is an enlarged longitudinal sectional view illustrating the details of the control valve of the variable capacity compressor shown in FIG. 3.

Next, the control valve 100 for a variable capacity compressor (hereinafter referred to simply as a control valve) according to this embodiment will be explained in detail. FIG. 3 shows the longitudinal sectional view of a state where the control valve 100 is incorporated into a variable capacity compressor 1, while FIG. 4 is a sectional view illustrating the details of the control valve 100 shown in FIG. 3.

The control valve 100 shown in FIG. 3 is mounted on the rear housing 3 side of the variable capacity compressor 1 shown in FIGS. 1 and 2. A main valve body 120 of the control valve 100 is disposed in a space 84 communicating with the discharge chamber 12 to be kept at the discharging pressure Pd of coolant in such a manner that it is hermetically sealed therein by means of O-rings 121*a* and 121*b*. To the upper end portion of the main valve body 120 is fittingly secured a strainer 122, through which the coolant gas for generating the high discharging pressure Pd in the interior of the valve chamber 123 formed in the main valve body 120 is designed to be introduced.

In the interior of the valve chamber 123, a spherical valve member 126 for effecting the closing or opening of the stopper 124 and of the valve hole 125 is disposed, and at the same time, a valve-closing spring 127 for urging the spherical valve member 126 in the direction of closing the valve is interposed between the stopper 124 and the spherical valve member 126.

The main valve body 120 is also provided with a port 114 to which the pressure Pc of the crankcase 8 is to be introduced. Accordingly, a coolant gas of high pressure which has been introduced into the interior of the valve chamber 123 through the strainer 122 can be introduced into the crankcase 8 through this port 114 and the passage 57 when the valve hole 125 is opened by the movement of the spherical valve member 126.

Furthermore, the main valve body 120 is provided with a suction port 129 which is communicated via a passage 80 shown in FIG. 1 with the suction chamber 13 and to which the suction pressure Ps of the suction chamber 13 is to be introduced. This suction port 129 is also communicated not only with a pressure sensitive chamber 145 via a suction passage 130 but also with a suction pressure-introducing space 85 which is located between the rear housing 3 and the solenoid housing 131. This suction pressure-introducing space 85 is hermetically sealed by means of an O-ring 131*b* mounted on a projected portion 131*a* formed on a side wall portion of the solenoid housing 131. With the provision of this suction pressure-introducing space 85, the side wall of the solenoid housing 131 can be entirely cooled by a low temperature coolant gas to be fed from the suction chamber 13 thereby inhibiting the solenoid 131A housed in the solenoid housing 131 from becoming high in temperature.

In the solenoid housing 131, there is also disposed a plunger 133 linked to the rod 132 which is disposed to contacted with and thereby to retain the spherical valve member 126. The plunger 133 is slidably sustained by a pipe 136 which is fixed to a pipe holder 135 hermetically contacted, through an O-ring 134, with the end portion 120*a* of the main valve body 120. The aforementioned rod 132 functions together with a stem 138 (to be explained hereinafter) as an operation bar.

The plunger 133 is provided at the rear end 133*a* thereof with a receiving hole 137 into which one end portion 139 of the stem 138 is inserted and secured thereto. The other end portion 140 of the stem 138 is slidably introduced into and sustained by a suction member 141 in such a manner that it is inserted through the receiving hole 142 of the suction member 141 and projected from the receiving hole 143 of the suction member 141. A spring 144 for urging the plunger 133 to keep away from the suction member 141 is interposed between the receiving hole 137 of the plunger 133 and the receiving hole 142 of the suction member 141.

Bellows 146 disposed in the pressure sensitive chamber 145 is provided on both sides thereof with a pair of stoppers 147 and 148, and one of the stoppers, i.e. the stopper 147 is detachably connected with the aforementioned other end portion 140 of the stem 138. A spring 150 for urging the stopper 147 to keep away from the suction member 141 is interposed between the flange 149 of the stopper 147 and the receiving hole 143 of the suction member 141.

It is designed that the maximum displacement of the bellows 146 is to be regulated by the contact between this pair of stoppers 147 and 148 as the bellows 146 is contracted due to an increase in the suction pressure Ps in the pressure sensitive chamber 145. It is also designed that the maximum displacement of the bellows 146 is smaller than the maximum fitting distance between the aforementioned other end 140 of the stem 138 and the stopper 147 of the bellows 146, thereby preventing the aforementioned other end 140 of the stem 138 from being disengaged out of the stopper 147 of the bellows 146.

Further, a pipe 151 defining the pressure sensitive chamber 145 is hermetically sustained, through an O-ring 156, by a plate 157, and an adjusting screw holder 152 is fitted in and secured to one end of the pipe 151. This adjusting screw holder 152 is provided therein an adjusting screw 153 for adjusting the intensity of the bellows 146, the adjusting screw 153 being hermetically pierced through the adjusting screw holder 152 by means of an O-ring 154. This adjusting screw 153 is disposed such that the tip end portion 155 thereof is contacted with the stopper 148 of the bellows 146.

Furthermore, a cord 158 for supplying a predetermined magnetizing current under the controlling by the controlling computer (not shown) is connected with the solenoid 131A.

Next, the operation of the variable capacity compressor 1 and control valve 100 according to this embodiment will be explained. First of all, the operation entirely of the variable capacity compressor 1 will be explained before explaining the operation of the control valve 100.

The rotational power of an automobile engine is transmitted from a pulley (not shown) to the shaft 5 via a belt (not shown), and the resultant rotational power of the shaft 5 is transmitted to the wobble plate 10 via the hinge structure 41 thereby causing the wobble plate 10 to rotate.

Due to the rotation of the wobble plate 10, the shoe 50 is also caused to rotate along the sliding surface 10*a* of the wobble plate 10, so that the rotational power of the wobble plate 10 is converted to a linear reciprocating motion of the piston 7. As a result, the reciprocating motion of the piston 7 in the cylinder bore 6 is taken place, thus resulting in a change in volume of the compression chamber 82 disposed inside the cylinder bore 6. As a result of this change in volume, the suction, compression and discharging of the coolant gas is sequentially taken place, whereby allowing the coolant gas to be discharged at a rate corresponding to the angle of inclination of the wobble plate 10. At the process of sucking, the suction valve 21 is opened, thereby allowing a low pressure coolant gas to be discharged from the suction chamber 13 to the compression chamber 82 disposed inside the cylinder bore 6.

When the heat load is decreased (which corresponds to the moment of clutch-off of a clutch compressor), the transmission of electric current to the solenoid of the control valve 100 is stopped, thus actuating the control valve 100 (the plunger 133) to move in the direction of opening the valve, i.e. the spherical valve member 126 of the control valve 100 is caused to move, against the urging force of the valve-closing spring 127, in the direction of opening the valve, thus opening the second passage 57. As a result, a high pressure coolant gas is allowed to flow from the discharge chamber 12 to the crankcase 8 via the second passage 57, thus increasing the pressure inside the crankcase 8.

The force acting on the rear surface of the piston 7 becomes larger during the compression stroke, resulting in that the total of the force imposed on the rear surface of the piston 7 exceeds over the total of the force imposed on the front surface of the piston 7, thus decreasing the inclination angle of the wobble plate 10. When the inclination angle of the wobble plate 10 becomes minimum, the hole 58*c* of the ring 9 is substantially closed by the boss 10*b* of the wobble plate 10, thereby extremely reducing the cross-sectional area of the first passage 58, thus inhibiting the crankcase 8 from being lowered in pressure.

When a difference in pressure between the discharge chamber 12 and the crankcase 8 is decreased to a predetermined value Po or less, or to such an extent that the power acting on the upper side of the spool valve 31, i.e. the total power of the pressure of crankcase 8 and the urging force of the spring 32, becomes higher than the pressure of the coolant gas of the discharge chamber 12 that is acting on the lower side of the spool valve 31, the spool valve 31 is caused to move in the direction to close the valve thereof, thus shutting down the discharge passage 39 (FIG. 2). As a result, the flow of the coolant gas from the discharge port 1*a* to the condenser 88 is stopped. At this moment, although the hole 58*c* of the ring 9 is substantially closed by the boss 10*b* of the wobble plate 10, and hence the cross-sectional area of the first passage 58 is extremely reduced, the coolant gas in the crankcase 8 is allowed to flow into the suction chamber 13 through the third passage 60. As a result, the crankcase 8 is prevented from being excessively increased in pressure, and at the same time, the coolant gas is allowed to circulate throughout the compressor 1.

At the moment of minimum piston stroke (a state shown in FIG. 2), the coolant gas is allowed to circulate passing successively through the suction chamber 13, the compression chamber 82, the discharge chamber 12, the second passage 57, the crankcase 8 and the third passage 60 in the mentioned order, thus returning again to the suction chamber 13.

On the other hand, the coolant gas in the crankcase 8 is allowed to flow, through the passage 60*a* of the front housing 4, the front side bearing-receiving space 60*b*, the passage 60*c* formed in the shaft 5, the rear side bearing-receiving space 60*d*, the passage 58*b* formed in the cylinder block 2 and the orifice 58*a* formed in the valve plate 2*a*, to the suction chamber 13. At this occasion, the coolant gas flow is restricted by the orifice 62*a* of the screw 62 which is located at an intermediate portion of the passage 60*c* of the shaft 5 at first, and subsequently restricted again by the orifice 58*a* of the valve plate 2*a*, and hence the pressure of the coolant gas is caused to reduce.

By the way, since the variable capacity compressor according to this embodiment is constructed such that one end of the spool valve 31 functioning as a discharge control valve is subjected to the pressure from the crankcase 8, while the other end of the spool valve 31 is subjected to the pressure from the discharge chamber 12, and that a spring of relatively small resilient force is employed as the spring 32 for urging the spool valve 31 in the direction to close the valve, the spool valve 31 can be conditioned to take a minimum piston stroke (a minimum load) as the pressure of the discharge chamber 12 is gradually lowered due to a decrease in heat load, so that the spool valve 31 can be maintained in an opened state until the cross-sectional area of the first passage 58 is reduced by the wobble plate 10.

On the other hand, when a heat load becomes large, an electric current is transmitted to the solenoid 131A of the control valve 100 thereby to actuate the plunger 133 to move in the direction to close the valve and to actuate the spherical valve member 126 to move in the direction to close the valve by way of the urging force of the valve-closing spring 127, thus stopping the passage of a coolant gas to the second passage 57. As a result, the inflow of a high pressure coolant gas from the discharge chamber 12 into the crankcase 8 can be prevented, thus lowering the pressure in the crankcase 8.

Furthermore, the force acting on the rear surface of the piston 7 during the compression stroke can be minimized, whereby the total force acting on the rear surface of the piston 7 becomes lower than the total force acting on the front surface of the piston 7, thus increasing the inclination angle of the wobble plate 10. When the inclination angle of the wobble plate 10 is changed from the minimum angle to the maximum angle, the boss 10*b* of the wobble plate 10 is moved away from the hole 58*c* of the ring 9, thus allowing the first passage 58 to open fully and hence allowing the coolant gas filled in the crankcase 8 to flow into the suction chamber through the first passage 58. As a result, the reduction in pressure of the crankcase 8 can be promoted. When the cross-sectional area of the first passage 58 is made maximum, the coolant gas is scarcely permitted to flow into the suction chamber 13 from the third passage 60.

When the pressure of the discharge chamber 12 becomes higher to such an extent that a difference in pressure between the discharge chamber 12 and the crankcase 8 becomes a predetermined value Po or more, the pressure of coolant gas existing in the discharge chamber 12 and acting on the spool valve 31 becomes higher than the total power of the pressure of coolant gas in the crankcase 8 and the urging force of the spring 32, so that the spool valve 31 is caused to move in the direction to open the valve, thus opening the discharge passage 39 (FIG. 1). As a result, the coolant gas in the discharge chamber 12 is permitted to flow from the discharge port 1*a* to the condenser 88.

Next, the operation of the control valve 100 according to this embodiment will be explained in detail.

First of all, under the condition where the solenoid 131A of the control valve 100 is magnetized, the plunger 133 is pulled, against the urging force of the spring 144, toward the suction member 141, so that the rod 132 linked with the plunger 133 is moved. As a result, the spherical valve member 126 attached to the rod 132 is caused to move in the direction to close the valve hole 125 of the main valve body 120. On the other hand, a low temperature coolant gas is introduced from the suction passage 80 communicating with the suction chamber 13 to the pressure sensitive chamber 145 through the suction port 129 of the main valve body 120 and the suction passage 130. As a result, the bellows 146 in the pressure sensitive chamber 145 is caused to displace according to the pressure of the coolant gas, i.e. the suction pressure Ps of the suction chamber 13. This displacement is then transmitted to the spherical valve member 126 via the stem 138, the plunger 133 and the rod 132. In this case, the position of opening degree of the valve hole 125 of the spherical valve member 126 is determined by the displacement force of the bellows 146, the valve-closing spring 127 and the spring 144.

When the suction pressure Ps of the interior of the pressure sensitive chamber 145 becomes high, the bellows 146 is contracted according to the suction pressure Ps. Therefore, the direction of this contraction agrees with the sucking direction of the plunger 133 to be effected by the solenoid 131A, and at the same time, the spherical valve member 126 is moved following the displacement of the bellows 146, thus reducing the opening degree of the valve hole 125. As a result, the quantity of a high pressure coolant gas to be introduced into the interior of the valve chamber 123 from the discharge chamber 12 via the strainer 122, and then introduced into the crankcase 8 of FIG. 1 via the port 114 and the second passage 57 is reduced (the pressure Pc of the crankcase is lowered), thus increasing the inclination angle of the wobble plate 10 shown in FIG. 1.

Further, since a low temperature coolant gas supplied from the suction passage 80 communicating with the suction chamber 13 is communicated with the suction pressure-introducing space 85 interposed between the rear housing 3 and the solenoid housing 131, the side wall of the solenoid housing 131 can be entirely cooled by this low temperature coolant gas supplied from the suction chamber 13, thus making it possible to inhibit the temperature rise of the solenoid 131A disposed inside the solenoid housing 131. On the other hand, when the suction pressure Ps in the interior of the pressure sensitive chamber 145 is lowered, the bellows 146 is expanded due to the spring 159 and to the restoring force of the bellows itself. As a result, in accordance with the displacement of the bellows 146, the spherical valve member 126 is pushed by way of the stem 138, the plunger 133 and the rod 132, whereby the spherical valve member 126 is moved in the direction to increase the opening degree of the valve hole 125. As a result, the quantity of a high pressure coolant gas to be introduced into the interior of the valve chamber 123 from the discharge chamber 12 via the strainer 122, and then introduced into the crankcase 8 of FIG. 1 via the port 114 and the second passage 57 is increased (the pressure Pc of the crankcase is raised), thus decreasing the inclination angle of the wobble plate 10 shown in FIG. 1.

On the other hand, under the condition where the solenoid 131A is demagnetized, the pulling of the plunger 133 toward the spring 144 is vanished, so that, due to the urging force of the spring 144, the plunger 133 is caused to move in the direction opposite to the side where the suction member 141 is disposed. As a result, the spherical valve member 126 is caused to move by way of the rod 132 in the direction to open the valve hole 125 of the main valve body 120. When the suction pressure Ps of the interior of the pressure sensitive chamber 145 is increased under this condition, the bellows 146 is caused to contract thereby decreasing the opening degree of the spherical valve member 126. However, since the other end portion 140 of the stem 138 is detachably contacted with the stopper 147 of the bellows 146, the displacement of the bellows 146 would not give any influence to the spherical valve member 126.

As a result, the spherical valve member 126 can be kept remained in a state of maximum opening degree without being influenced by an increase in suction pressure Ps of the interior of the pressure sensitive chamber 145.

Additionally, since it is designed such that the maximum displacement of the bellows 146 becomes smaller than the maximum fitting distance between the aforementioned other end 140 of the stem 138 and the stopper 147 of the bellows 146, the aforementioned other end 140 of the stem 138 can be prevented from being disengaged out of the stopper 147 of the bellows 146.

As mentioned above, according to the control valve 100 of this embodiment, at the occasion of introducing a low temperature coolant gas into the pressure sensitive chamber 145 of the main valve body 120 from the suction chamber 13, the low temperature coolant gas is introduced at first into the suction pressure-introducing space 85 interposed between the rear housing 3 and the solenoid housing 131, so that the side wall of the solenoid housing 131 can be entirely cooled by this low temperature coolant gas. As a result, it possible to inhibit the deterioration in magnetization of the solenoid 131A disposed inside the solenoid housing 131.

Further, since an adjusting screw holder 152 provided with an adjusting screw 153 for adjusting the strength of the bellows 146 is hermetically attached to the pressure sensitive chamber 145 so as to make it possible to perform the adjustment in strength of the bellows 146 in the pressure sensitive chamber 145 by adjusting the adjusting screw 153 from outside of the main valve body 120, it is now possible to easily perform the adjustment in strength of the bellows 146 hermetically housed in the pressure sensitive chamber 145.

Moreover, since the main valve body 120 is integrally incorporated in a rear housing 210 of the variable capacity compressor 200 with the aforementioned adjusting screw holder 152 being directed outward, it is now possible to easily perform the adjustment in strength of the bellows 146 from outside even under the condition where the main valve body 120 is kept attached to the rear housing 210.

Additionally, since the stem 138 constituting part of the operating bar is located near the pressure sensitive chamber 145 and disposed in the interior of the solenoid 131A which is designed to pull the stem 138 in the direction to reduce the opening degree of the spherical valve member 126 so as to minimize the distance between the application point to be effected on the operating bar by the suction of the solenoid 131A and the application point to be effected on the operating bar by the urging force of the bellows 146, the rattling of the operating bar can be minimized at the occasion of moving the operating bar in the direction of closing the valve.

Further, since the valve member 126 is spherical in shape, the valve member 126 can be uniformly contacted with the valve hole 125 even if the rod 132 is inclined at the occasion of closing the valve.

Figure 5:
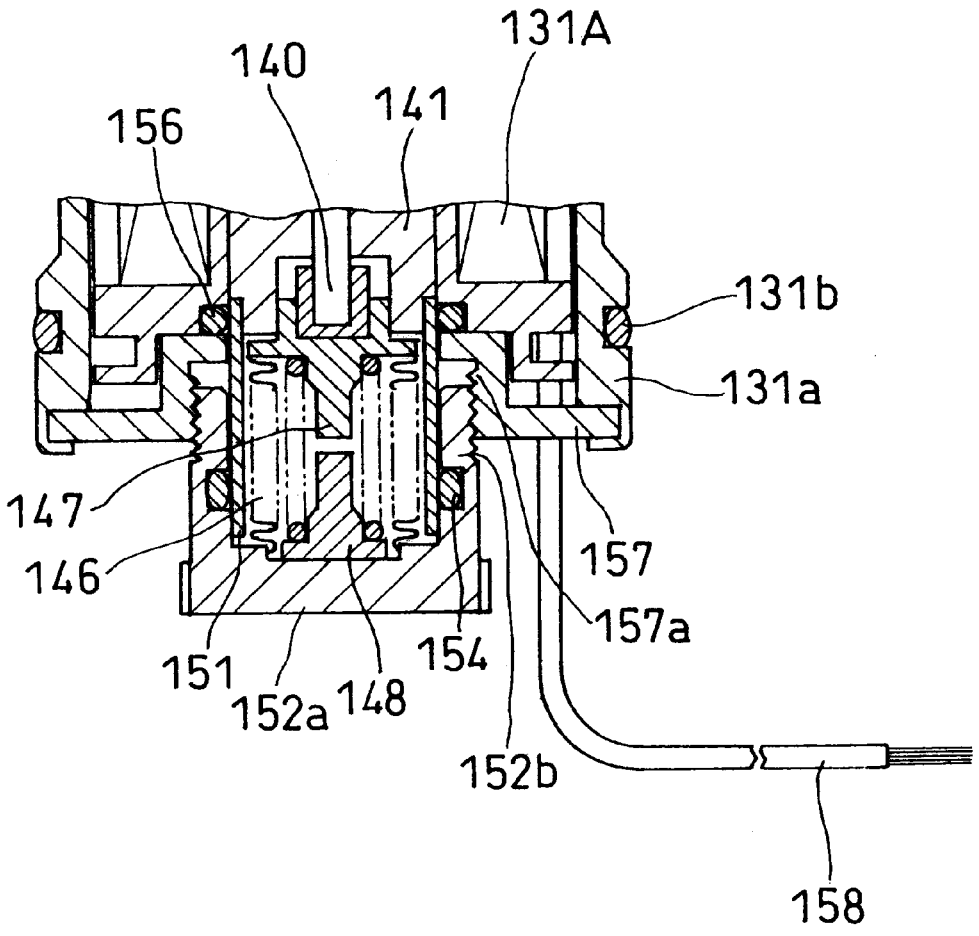
FIG. 5 is a longitudinal sectional view illustrating a main portion of a control valve of variable capacity compressor according to another embodiment of the present invention.
Figure 6:
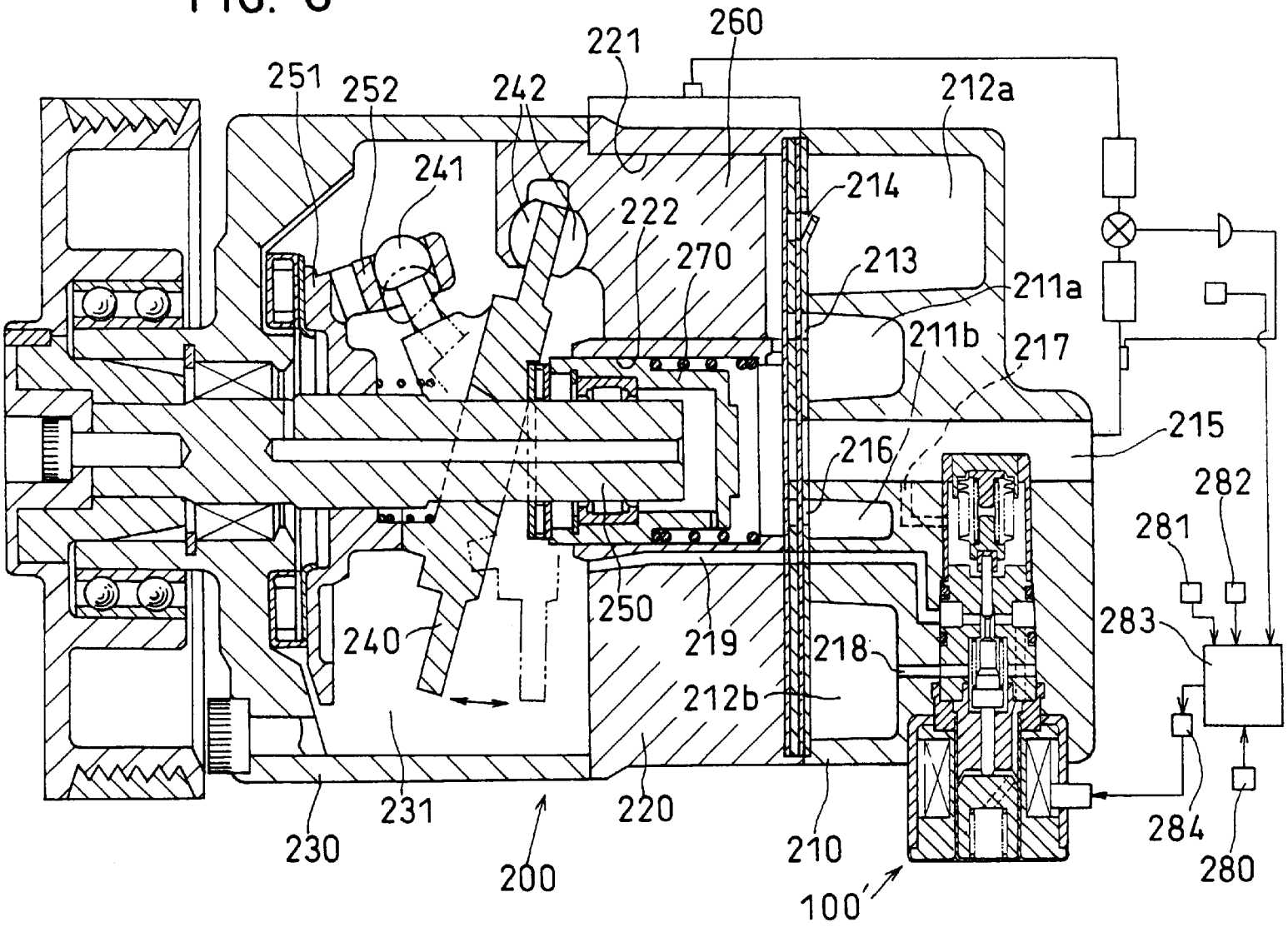
FIG. 6 is a longitudinal sectional view illustrating a variable capacity compressor provided with a conventional control valve.
Figure 7:
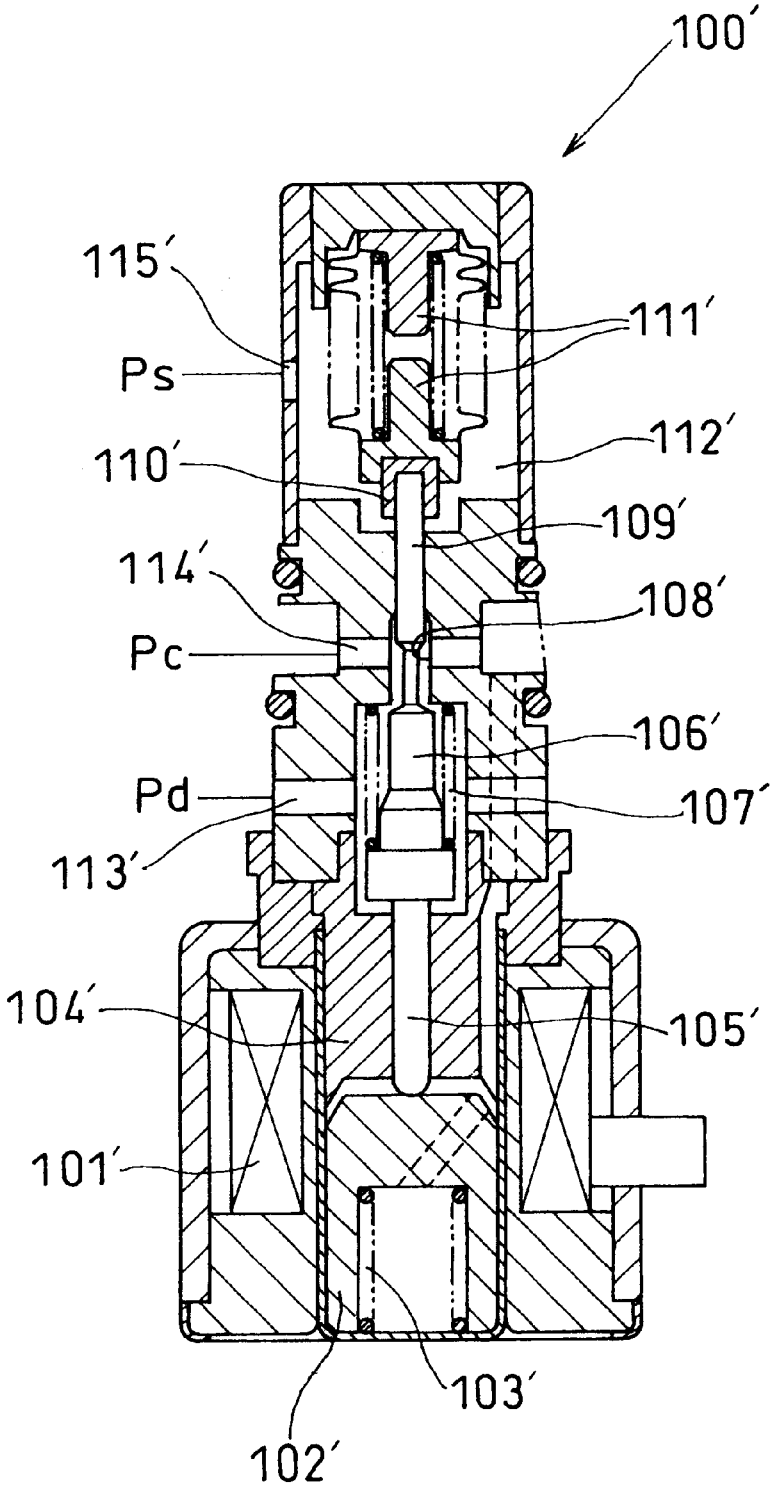
FIG. 7 is a longitudinal sectional view illustrating in detail the control valve for the variable capacity compressor which is shown in FIG. 6.

In the foregoing embodiment, the adjusting screw 153 and the adjusting screw holder 152 are respectively employed as a separate body. However, the present invention is not limited to such an embodiment. For example, these adjusting screw and adjusting screw holder can be integrated thus forming a cap structure 152*a* as shown in FIG. 5 illustrating a main portion of such an alternative embodiment. Namely, this cap structure 152*a* is provided with an external thread portion 152*b* with which the female screw portion 157*a* formed on the inner wall of a plate 157 is engaged so as to make it possible to perform an adjustment of their relative locations. The air-tightness between the external thread portion 152*b* and the female screw portion 157*a* is ensured by means of an O-ring 154.

As would be clearly understood from the above explanations, according to the control valve for a variable capacity compressor of this invention, at the occasion of introducing a low temperature coolant gas into the pressure sensitive chamber of the main valve body from the suction chamber, the low temperature coolant gas is introduced at first into the suction pressure-introducing space interposed between the rear housing and the solenoid housing, so that the side wall of the solenoid housing can be entirely cooled by this low temperature coolant gas. As a result, it possible to inhibit the deterioration in magnetization of the solenoid disposed inside the solenoid housing.

Further, since the main valve body is constructed such that one end of a stem is fixed at one end of the plunger of the solenoid, that the stopper of the bellows placed in the pressure sensitive chamber is detachably disposed at the other end of the stem, that a rod to be contacted with the valve member is fixed at the other end of the plunger, and that a spring for urging the plunger of the solenoid toward the valve member is disposed at one end of the plunger, the valve member can be normally kept in a state of maximum opening degree, without being influenced by the action of the bellows inside the pressure sensitive chamber, during the period when the plunger is not magnetized by the solenoid.

What is claimed is:

1. A control valve for a variable capacity compressor; wherein an opening degree of a valve member disposed in a coolant gas passage for communicating a discharge pressure region of the variable capacity compressor with a crankcase thereof is made adjustable by a magnetization action of a solenoid disposed in a solenoid housing which is mounted on a main valve body, thereby causing an inclination angle of a wobble plate disposed inside the crankcase to be changed and at the same time, causing a discharging capacity of the compressor to be changed; and which is characterized in that;

said main valve body is integrally incorporated in a rear housing of the variable capacity compressor, and that a low temperature coolant gas-introducing space communicating with a suction pressure region of the variable capacity compressor is formed between the solenoid housing and the rear housing.

2. A control valve for a variable capacity compressor; wherein an opening degree of a valve member disposed in a coolant gas passage for communicating a discharge pressure region of the variable capacity compressor with a crankcase thereof is made adjustable by a magnetization action of a solenoid disposed in a solenoid housing which is mounted on a main valve body, thereby causing an inclination angle of a wobble plate disposed inside the crankcase to be changed and at the same time, causing a discharging capacity of the compressor to be changed; and which is characterized in that;

said main valve body comprises a pressure sensitive chamber communicating with a suction pressure region of the variable capacity compressor, bellows housed in the pressure sensitive chamber and functioning to move the valve member in the direction to reduce the opening degree thereof as the pressure of the suction pressure region is increased, and an adjusting screw holder hermetically attached to the pressure sensitive chamber and provided with an adjusting screw for adjusting the strength of the bellows and the displacement of the solenoid.

3. The control valve for a variable capacity compressor according to claim 2, wherein said main valve body is integrally incorporated in the rear housing of the variable capacity compressor with said adjusting screw holder being kept directed toward outside.

4. The control valve for a variable capacity compressor according to claim 2, wherein said adjusting screw holder is formed of a hermetical cap integrally provided with said adjusting screw.

5. A control valve for a variable capacity compressor; wherein an opening degree of a valve member disposed in a coolant gas passage for communicating a discharge pressure region of the variable capacity compressor with a crankcase thereof is made adjustable by a magnetization action of a solenoid disposed in a solenoid housing which is mounted on a main valve body, thereby causing an inclination angle of a wobble plate disposed inside the crankcase to be changed and at the same time, causing a discharging capacity of the compressor to be changed; and which is characterized in that;

said main valve body comprises a solenoid which is disposed at the center thereof, a pressure sensitive chamber provided with bellows is disposed at one end thereof, and a valve chamber provided with said valve member which is disposed at the other end thereof.

6. The control valve for a variable capacity compressor according to claim 5, wherein said solenoid is provided with a plunger whose one end is connected with one end of a stem, the other end of said stem is detachably contacted with a stopper of the bellows placed in the pressure sensitive chamber, and the other end of the plunger is linked to a rod to be contacted with said valve member.

7. The control valve for a variable capacity compressor according to claim 6, wherein a spring for urging the plunger of said solenoid toward said valve member is disposed at one end of the plunger of said solenoid.

8. The control valve for a variable capacity compressor according to any one of claims 1 to 7, wherein said valve member is spherical in shape.

* * * * *